US005303424A

United States Patent [19]

Cromartie

[11] Patent Number: 5,303,424

[45] Date of Patent: Apr. 19, 1994

[54] SWIMWEAR VENT FOR WATER SKIERS

[76] Inventor: Hendrick L. Cromartie, 2 Ridgewood Rd., Rome, Ga. 30165

[21] Appl. No.: 764,789

[22] Filed: Sep. 24, 1991

[51] Int. Cl.[5] ..... A41D 7/00

[52] U.S. Cl. ..... 2/67; 2/228; 2/227; 2/238; 2/DIG. 1

[58] Field of Search ..... 2/67, 228, 238, 227, 2/DIG. 1

[56] References Cited

U.S. PATENT DOCUMENTS

| | | | |
|---|---|---|---|
| 2,790,176 | 4/1957 | Cunningham | 2/67 |
| 3,436,762 | 4/1969 | Cahan | 2/67 |
| 4,145,762 | 3/1979 | Wallach | 2/67 |
| 4,179,754 | 12/1979 | Denu | 2/67 |
| 4,989,273 | 2/1991 | Cromartie | 2/67 |

*Primary Examiner*—Werner H. Schroeder
*Assistant Examiner*—Gloria Hale
*Attorney, Agent, or Firm*—Vivian L. Steadman; Harry I. Leon

[57] ABSTRACT

A boxer-type swim suit for a water skier in which the suit has at least one rear panel, a liner attached thereto along a waistband, a band attached to the rear panel and an elongated strip having its upper edge joined to the rear panel and its lower edge joined to the liner. The elongated strip and band define opposing sides of a vent which extends across substantially the entire width of the rear portion of the swim suit. The vent allows first water and then air to escape which would otherwise be trapped below the waistband of a water skier's swim suit. Both the strip and band are disposed generally parallel to an edge of the waistband and proximate thereto and are joined to each other along a plurality of junctures situated between the ends of the band. Disposed generally perpendicularly to the waistband, contiguous pairs of these junctures are spaced sufficiently apart from each other to allow either water or air to flow substantially unimpeded through the vent.

5 Claims, 1 Drawing Sheet

SWIMWEAR VENT FOR WATER SKIERS

BACKGROUND OF THE INVENTION

The present invention relates to openings in swimwear and in particular to vents for boxer-type swim suits.

For a variety of reasons, most water skiers prefer to wear loose-fitting, boxer-type swim suits instead of short, form-fitting suits. Even so, these water skiers have in the past experienced a discomforting phenomenon.

At the beginning of a ski run, the pressure of water acting on the legs of a loose-fitting, boxer-type suit tends to cause these legs to balloon rearwardly. Water is temporarily trapped below the waistband of the suit. Then, as the skier emerges from the water, air becomes trapped in the same position. Built up as air pressure resists the skier's forward momentum, this air fills the legs of the suit, bulging them outwardly, like a parachute, behind the wearer's body.

The drag created first by water resistance and then by air resistance on loose-fitting swimmer only adds to the forces which must be overcome by the pull of a tow rope on a skier's hands, arms, and shoulders. Especially at the level of tournament competition, a level at which many skiers perform practice repetitions one after another each day, this drag contributes significantly to the strenuousness of a very demanding sport.

In addition to the fatigue caused by tension from the pull of a tow rope on a skier's hands, arms and shoulders, rearward ballooning of the bathing suit creates a discomforting sensation. Moreover, the great force of water pressure on a swim suit could, on occasion, cause it to tear.

SUMMARY OF THE INVENTION

It is among the objects of this invention to provide an improved swim suit of the type having both loose-fitting legs and a waistband adapted to hold the suit securely about a skier's waist, the improved suit including a vent to relieve water pressure or, alternately, air pressure which may build up on rear portions of the suit during forward motion of its wearer.

In accordance with the invention, there is provided such a boxer-type swim suit having a vent disposed generally parallel to the waistband and proximate therewith.

DESCRIPTION OF THE PREFERRED EMBODIMENT

Figure 4:
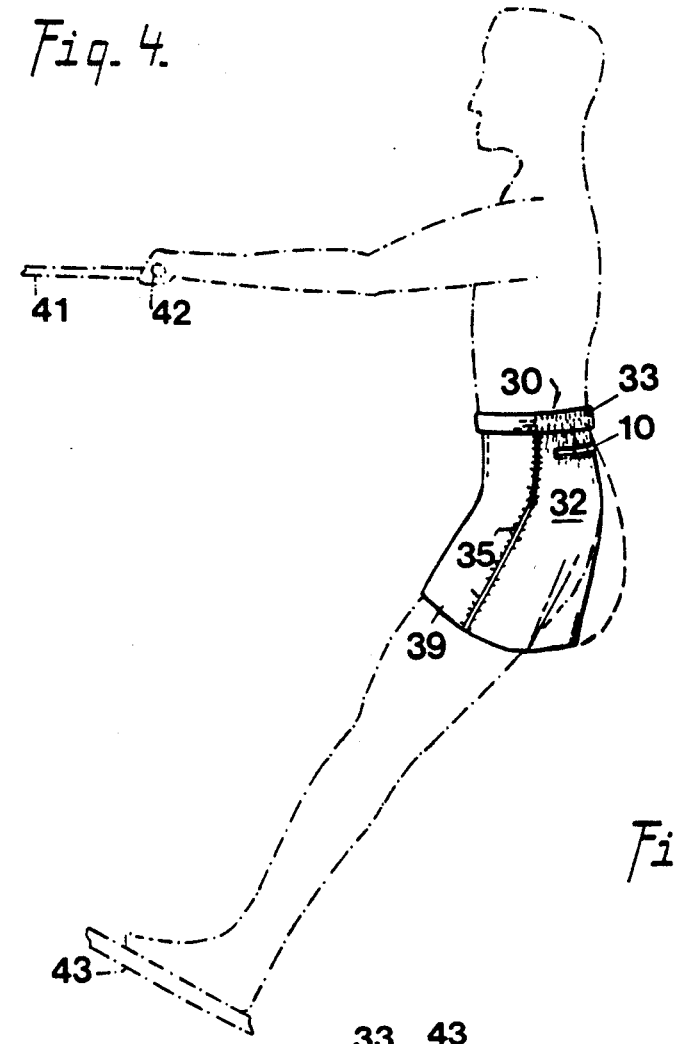
FIG. 4 shows a side view, on a reduced scale, of the swim suit according to FIG. 1, when the suit is worn by a water skier, a dashed line at the rear of the skier illustrating the position which would be assumed by the rear portion of the suit in the absence of the vent according to the present invention.

Referring to the drawings, an improved boxer-type bathing suit 30 for water skiers comprises a vent, indicated generally by the reference numeral 10. The suit 30 further includes a waistband 33, a snug-fitting liner 37, a pair of rear panels 31, 32 and a pair of front panels 38, 39, the rear panels being joined to the front panels by reinforced seams 34, 35, respectively, and to each other by a seam 36. The liner 37, which underlies the front and rear panels, is fabricated from a porous, net-like material such as nylon mesh or the like and is secured to each of the panels along the bottom edge of the waistband 33. The top edges of the liner 37 and of the rear panels 31, 32 are gathered together by an elastic band 26 which is secured to them by a row 41 of expandible stitching. Additional rows 42, 43 of expandible stitching may also be employed to attach the rear panels 31, 32, as well as a piece 45 joined thereto along a seam 44, to the elastic band 26.

The vent 10 includes at least one elongated band 11 and a strip 15. In the preferred embodiment illustrated in FIG. 3, the band 11 is a flexible fabric material of double thickness, reinforced by rows 13 of stitching and joined, along its lower edge, to the panels 31, 32 by a seam 12. The strip 15, on the other hand, is joined along its upper edge to the rear panels 31 and 32 by a seam 16. To keep the strip from inadvertently obstructing the vent 10, the lower edge of the strip is also joined to the liner 37 along a seam 17. In the preferred embodiment, the position of the seam 17 measures, by way of example, 2½ inches below the top edge of the band 11.

Figure 3:
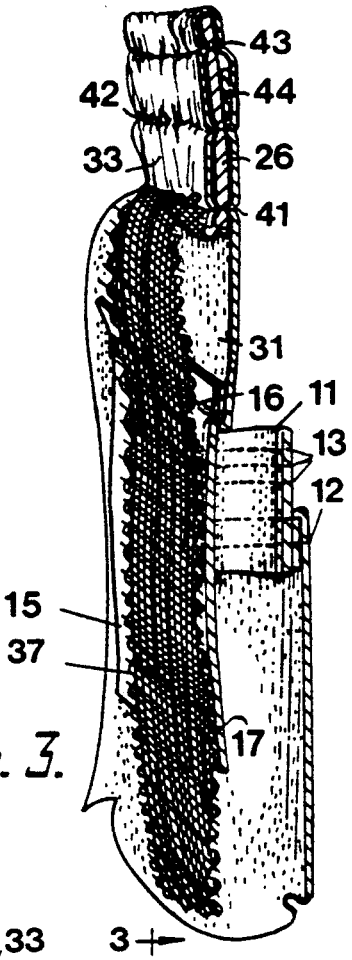
FIG. 3 is a cross-section 3—3 from FIG. 1 on an enlarged scale.
Figure 2:
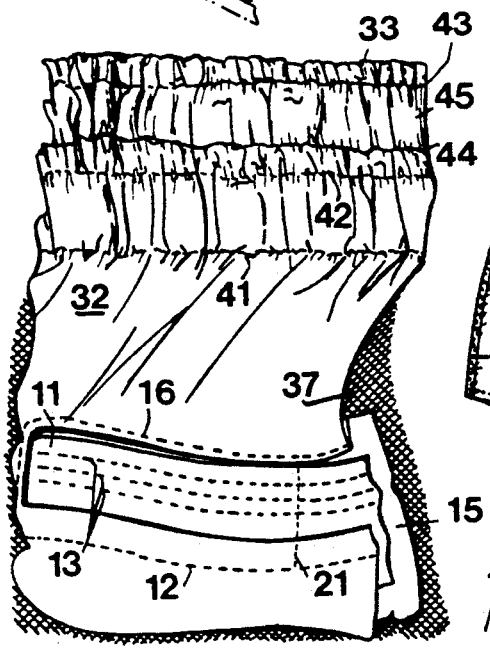
FIG. 2 is an enlarged fragmentary section of the vent in the swim suit according to FIG. 1.

Disposed generally symmetrically and transversely across the rear portion of the swim suit 30, the strip 15 and the band 11 line opposing sides of the vent 10 (FIGS. 2 and 3). In the preferred embodiment illustrated in FIGS. 1–3, the vent 10 extends as a unitary piece across substantially the entire width of the rear portion of the swim suit 30. This configuration of the vent 10 facilitates the escape of water or air which might otherwise become trapped beneath the rear portion of a water skier's swim suit 30. Alternately, more than one vent can be provided, the combined lengths of the vents being substantially equal to the width of the rear portion of the suit 30.

Figure 1:
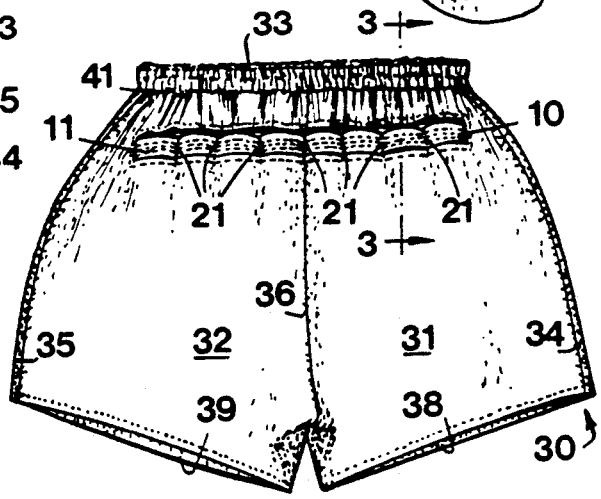
FIG. 1. is a rear elevational view of a typical boxer-type swim suit having a vent according to the present invention.

As illustrated in FIGS. 1–4, the vent 10 is situated a short distance below the waistband 33, but sufficiently far from it to allow slackness needed to prevent any restriction in the vent 10 due to the elastic band 26. At the same time, the distance is preferably one which tends to minimize any buildup of either water or air below the waistband while the wearer is beginning his ski run and which also allows air and water to escape through the vent when the wearer has assumed a water skier's posture, with its characteristic slight forward bend at the waist (FIG. 1). In the preferred embodiment, the distance between the top edge of the waistband 33 and the top edge of the band 11 measures, by way of example, 2½ inches or about 1¼ inches below the seam 41.

The strip 15, which is generally hidden beneath the band 11, is employed to shield portions of the wearer's body situated beneath the net-like liner 37. In the absence of the strip 15, these portions of the wearer's posterior might be exposed to view. For esthetic reasons and to further protect the modesty of the wearer, the band 11 is preferably tacked, but at well spaced apart intervals, to the strip 15. In the preferred embodiment, contiguous pairs of vertical tacks 21 are separated from each other by intervals which measure, by way of example, in a range of 1½ to 2¼ inches. The larger of these intervals are most suitable for use with large swim suits in which the vent 10 typically measures about 18 inches in length while the smaller intervals are most suitable for use with medium and small swim suits having vents 10 which are about 16 inches in length. Not only are contiguous pairs of junctures between the band 11 and the strip 15, such as the vertical tacks 21, substantially separated from each other but also each of these junctures is aligned generally perpendicularly to the longitudinal centerline of the band 11, thereby enabling water or air to flow, largely unimpeded, through the vent 10.

It will be understood that the invention is not limited to the embodiments disclosed, but is capable of numerous rearrangements, modifications and substitutions without departing from the scope of the invention.

What is claimed is:

1. In a boxer-type swim suit having a waistband, a liner, and at least one rear panel, the liner being attached to the rear panel along an edge of the waistband, the suit having an elongated strip and a band, the elongated strip having an upper edge and a lower edge, the strip being attached at the upper edge to the rear panel and at its lower edge to the liner, the band being attached to the rear panel, the elongated strip and the elongated band being disposed generally parallel to said edge of the waistband and proximate thereto, the strip and the band defining opposing sides of a vent allowing the passage of fluid from interior of the rear panel to exterior of the rear panel.

2. In a boxer-type swim suit having a waistband and at least one rear panel, an upper edge of the panel being gathered and attached to an edge of the waistband, the panel having a substantial width in a direction parallel to the waistband, the suit having an elongated strip and an elongated band attached to the rear panel, the elongated strip and the elongated band being disposed generally parallel to said edge of the waistband and proximate thereto and extending across most of said rear panel width, the strip and the band defining opposing sides of a vent allowing the passage of fluid from interior of the rear panel to exterior of the rear panel.

3. The suit according to claim 2 wherein the band has a pair of ends, the band and the strip being joined to each other at points situated between the ends of the band, each of the junctures between the band and the strip formed by these points being disposed generally perpendicularly to said edge of the waistband, the strip and the band having at least two contiguous pairs of said junctures in which the junctures are spaced sufficiently apart from each other to allow substantially unimpeded fluid passage through the vent and between the junctures so spaced apart.

4. In a boxer-type swim suit having a waistband and at least one rear panel, an upper edge of the panel being gathered and attached to an edge of the waistband, the suit having an elongated strip and an elongated band attached to the rear panel, the strip and the band defining opposing sides of a vent allowing the passage of fluid from interior of the rear panel to exterior of the rear panel.

5. The suit according to claim 4 which has at least one vent disposed generally symmetrically with respect to an imaginary line disposed perpendicularly to the waistband.

* * * * *